US010913172B2

(12) United States Patent
Moustakas et al.

(10) Patent No.: US 10,913,172 B2
(45) Date of Patent: Feb. 9, 2021

(54) SHAVING HEAD

(71) Applicant: BIC-VIOLEX S.A., Anixi (GR)

(72) Inventors: Panagiotis Moustakas, Athens (GR); Christoforos-Athanassios Brellis, Athens (GR)

(73) Assignee: BIC-VIOLEX SA, Anixi (GR)

( * ) Notice: Subject to any disclaimer, the term of this patent is extended or adjusted under 35 U.S.C. 154(b) by 7 days.

(21) Appl. No.: 15/769,372

(22) PCT Filed: Dec. 16, 2016

(86) PCT No.: PCT/IB2016/057721
§ 371 (c)(1),
(2) Date: Apr. 19, 2018

(87) PCT Pub. No.: WO2017/103879
PCT Pub. Date: Jun. 22, 2017

(65) Prior Publication Data

US 2018/0311845 A1 Nov. 1, 2018

Related U.S. Application Data

(60) Provisional application No. 62/268,648, filed on Dec. 17, 2015, provisional application No. 62/268,658, filed on Dec. 17, 2015.

(51) Int. Cl.

| | |
|---|---|
| ***B26B 21/40*** | (2006.01) |
| ***B26B 21/06*** | (2006.01) |
| ***B26B 21/22*** | (2006.01) |
| *B26B 21/44* | (2006.01) |

(52) U.S. Cl.
CPC ..... *B26B 21/4012* (2013.01); *B26B 21/4025* (2013.01); *B26B 21/4068* (2013.01); *B26B 21/06* (2013.01); *B26B 21/225* (2013.01); *B26B 21/443* (2013.01)

(58) Field of Classification Search
CPC .. B26B 21/4012; B26B 21/14; B26B 21/4068
See application file for complete search history.

(56) References Cited

U.S. PATENT DOCUMENTS 979,296 A * 12/1910 Heissenberger ..... B26B 21/446 30/41
3,590,483 A * 7/1971 Szczepanski ..... B26B 5/00 30/31

(Continued)

FOREIGN PATENT DOCUMENTS

CN 1404433 A 3/2003
CN 103608153 B 2/2014

(Continued)

OTHER PUBLICATIONS

International Search Report for PCT/IB2016/057721, dated Feb. 21, 2017.

(Continued)

*Primary Examiner* — Sean M Michalski
(74) *Attorney, Agent, or Firm* — Polsinelli PC

(57) ABSTRACT

A shaving head having a retainer with a plurality of legs operable to abut various portions of the shaving head, thereby securing components of the shaving head thereto.

14 Claims, 7 Drawing Sheets

(56) References Cited

U.S. PATENT DOCUMENTS 3,852,883 A * 12/1974 Ferraro ..... B26B 21/22 30/346.58
3,994,050 A * 11/1976 Bub ..... A47G 1/0638 24/562
4,389,773 A * 6/1983 Nissen ..... B26B 21/22 30/32
4,403,412 A * 9/1983 Trotta ..... B26B 21/227 30/47
4,605,978 A * 8/1986 Zeavin ..... F16B 2/245 24/457
4,794,692 A * 1/1989 Wang ..... G01B 3/1084 30/123
4,852,254 A * 8/1989 Duncan ..... B26B 21/06 30/50
4,866,844 A * 9/1989 Burout, III ..... B26B 21/22 30/50
4,932,122 A * 6/1990 Shurland ..... B26B 21/222 30/346.5
5,056,222 A * 10/1991 Miller ..... B26B 21/227 30/77
5,067,238 A * 11/1991 Miller ..... B26B 21/227 30/34.2
5,070,612 A * 12/1991 Abatemarco ..... B26B 21/227 30/50
5,092,042 A * 3/1992 Miller ..... B26B 21/4031 30/34.2
5,222,300 A * 6/1993 Althaus ..... B26B 21/227 30/47
5,224,267 A * 7/1993 Simms ..... B26B 21/4068 30/50
5,377,409 A * 1/1995 Chen ..... B26B 21/4012 30/41
5,416,974 A * 5/1995 Wain ..... B26B 21/227 30/50
5,497,550 A * 3/1996 Trotta ..... B26B 21/60 30/50
5,501,014 A * 3/1996 Hegemann ..... B26B 21/222 30/346.5
5,671,534 A 9/1997 Mayerovitch
6,009,624 A * 1/2000 Apprille, Jr. ..... B26B 21/227 30/50
6,161,287 A * 12/2000 Swanson ..... B26B 21/4018 30/50
6,173,498 B1 * 1/2001 Warrick ..... B26B 21/227 30/50
6,212,777 B1 * 4/2001 Gilder ..... B26B 21/4031 30/50
6,243,951 B1 * 6/2001 Oldroyd ..... B26B 21/227 30/34.2
6,397,473 B1 * 6/2002 Clark ..... B26B 21/227 30/50
7,111,401 B2 * 9/2006 Richard ..... B26B 21/222 30/346.5
7,131,202 B2 * 11/2006 Pennell ..... B26B 21/4031 30/50
7,877,879 B2 * 2/2011 Nakasuka ..... B26B 21/44 30/41
8,327,545 B2 * 12/2012 Peterson ..... B26B 21/565 30/346.61
9,539,734 B1 * 1/2017 Bozikis ..... B26B 21/4012
9,757,870 B2 * 9/2017 Giannopoulos ..... B26B 21/14
D832,516 S * 10/2018 Bozikis ..... D28/47
2002/0046465 A1 * 4/2002 McCool ..... B26B 21/222 30/50
2003/0006347 A1 * 1/2003 Ogden ..... F16L 3/245 248/58
2004/0119657 A1 * 6/2004 Mayer ..... H01Q 1/362 343/906
2004/0258385 A1 * 12/2004 Kadrnoska ..... H02G 9/025 385/136
2005/0091855 A1 * 5/2005 Hannan ..... B26B 21/56 30/346.5
2005/0188539 A1 * 9/2005 Prudden, Jr. ..... B26B 21/4018 30/41
2007/0209206 A1 * 9/2007 Van Eibergen Santhagens ..... B26B 21/222 30/50
2008/0066315 A1 * 3/2008 Xu ..... B26B 21/565 30/50
2008/0115449 A1 * 5/2008 Kodi ..... E04G 21/122 52/719
2008/0196251 A1 * 8/2008 Royle ..... B26B 21/4012 30/50
2009/0056142 A1 * 3/2009 Royle ..... B26B 21/38 30/43.7
2009/0188112 A1 * 7/2009 Prochaska ..... B26B 21/4018 30/34.05
2009/0193659 A1 * 8/2009 Park ..... B26B 21/4068 30/50
2010/0077619 A1 * 4/2010 Follo ..... B26B 21/227 30/50
2010/0154222 A1 * 6/2010 Nakasuka ..... B26B 21/225 30/50
2010/0175265 A1 * 7/2010 Bozikis ..... B26B 21/227 30/50
2011/0119922 A1 * 5/2011 Ntavos ..... B26B 21/4075 30/32
2011/0225828 A1 9/2011 Bruno
2011/0232100 A1 * 9/2011 Park ..... B26B 21/565 30/50
2011/0289779 A1 * 12/2011 Volodin ..... B26B 21/227 30/50
2012/0011725 A1 * 1/2012 Gratsias ..... B26B 21/227 30/50
2012/0324737 A1 * 12/2012 Howell ..... B26B 21/4031 30/50
2013/0097872 A1 * 4/2013 Blatter ..... B26B 21/4018 30/50
2013/0205595 A1 * 8/2013 Bykowski ..... B26B 21/4012 30/64
2014/0150217 A1 * 6/2014 Valiulis ..... G09F 3/16 24/489
2014/0163488 A1 * 6/2014 Vaillancourt ..... A61M 39/284 604/319
2014/0230252 A1 * 8/2014 Davos ..... B26B 21/4068 30/50
2015/0021446 A1 * 1/2015 Korcz ..... F16L 3/12 248/58
2015/0082638 A1 * 3/2015 Georgakis ..... B26B 21/222 30/77
2015/0090085 A1 * 4/2015 Griffin ..... B26B 21/4012 83/13
2016/0297086 A1 * 10/2016 Efthimiadis ..... B26B 21/4037
2018/0311847 A1 * 11/2018 Ntavos ..... B26B 21/4012
2018/0354146 A1 * 12/2018 Brellis ..... B26B 21/222
2018/0361604 A1 * 12/2018 Bozikis ..... B26B 21/4012
2019/0016001 A1 * 1/2019 Zucker ..... B26B 21/22
2019/0160698 A1 * 5/2019 Efthimiadis ..... B26B 21/56
2019/0168402 A1 * 6/2019 Efthimiadis ..... B26B 21/565

FOREIGN PATENT DOCUMENTS

CN 104428108 B 3/2015
WO 2015-090385 A1 6/2015

OTHER PUBLICATIONS

Chinese Search Report for Chinese Patent Application No. CN2016800634023, dated Oct. 22, 2019.

* cited by examiner

SHAVING HEAD

CROSS-REFERENCE TO RELATED APPLICATIONS

This application is a National Stage application of International Application No. PCT/IB2016/057721, filed Dec. 16, 2016, which claims priority to U.S. Provisional Patent Application No. 62/268,658, filed in the U.S. Patent and Trademark Office on Dec. 17, 2015 and U.S. Provisional Patent Application No. 62/268,648 filed in the U.S. Patent and Trademark Office on Dec. 17, 2015, all of which are incorporated herein by reference in their entireties for all purposes.

BACKGROUND

1. Field

The following description relates to shaving razors. A shaving head of a shaving razor may include one or more blades and a retainer configured to retain components of the shaving head. For example, a shaving razor may include a head with one or more blades which are secured in the head by a top retainer. The top retainer may include a plurality of legs to abut various portions of the shaving head, thereby securing components of the shaving head thereto.

2. Description of Related Art

Shaving razors include shaving heads which contain components such as shaving blades, lubrication strips, guard bars, covers, and trimming blades. The components in conventional shaving heads would be individually and separately retained within the shaving head. As such, the components would each have separate retaining means; for example traditional clips may be utilized for each component. However, bending traditional clip legs at multiple locations of the cartridge provides for difficulties in manufacturing while also providing multiple locations for retaining the components and managing the tolerances that are applied to the components.

Further, several disadvantages are typically encountered in the manufacture of such conventional mechanisms. During the manufacturing process, clips may encounter buckling as a result of force that is applied during installation of the clips. As a result of bending force exerted on the clips, the clips have a tendency to buckle upwards. Consequently, blade exposures may be unstable throughout the razor cartridge and may vary significantly from intended blade exposure values. Also, during the manufacturing process, clips may fail to be properly installed in a razor housing, which requires additional attention and labor to ensure that all of the clips are properly installed in the housing. Thus, the manufacture of such conventional mechanisms is inefficient, which results in production delays and increased production costs.

SUMMARY

The present inventive concept provides a shaving razor that overcomes the aforementioned disadvantages of conventional shaving razors. The shaving razor of the present inventive concept generally includes a shaving head with a housing and one or more components. The components may be at least one blade, a guard bar, a cap, at least one lubrication strip, or a combination thereof. The components are partially covered and secured to the housing by a retainer securely mounted on each side of the shaving head.

The aforementioned may be achieved in an aspect of the present inventive concept by providing a retainer operable to secure a plurality of shaving head components on a shaving head. The retainer may include a retainer body extending along a plane in first and second directions and having (i) a front leg extending from a front of the body in the first direction, and/or (ii) a rear leg extending from a rear of the body in the second direction. A tip of the front leg may define an outermost point of the retainer along the plane in the first direction. Each of the front leg and the rear leg may (i) partially surrounds a portion of the shaving head, and/or (ii) extends into a portion of the shaving head.

The body may include at least one side leg extending from a side of the body. The at least one side leg may extend at least partially perpendicular to the front leg and the rear leg. The at least one side leg may extend into a portion of the shaving head. The at least one side leg may include a plurality of side legs Each of the side legs may extend parallel to each other and/or at least partially along the plane Each of the side legs may be operable to surround a side portion of the shaving head and/or abut a bottom portion of the shaving head.

The front leg may include (i) a linear portion extending parallel to the body along the plane, and/or (ii) a curved portion that causes the front leg to extend nonparallel to the body. Each of the body, the rear leg, and the at least one side leg may define and/or partially surround an interior cavity. The body may include an abutment surface operable to abut one or more of the plurality of shaving head components. Each of the front leg, the rear leg, and/or the at least one side leg may include an abutment surface operable to abut (i) a bottom side of the shaving head, or (ii) a slot. The abutment surface of the body, the rear leg, and the at least one side leg may be on an interior side facing the interior cavity. The abutment surface of the front leg may be on an exterior side.

Each of the front leg and the rear leg may be operable to be received via a slot in an end cap of the shaving head. The end cap may be operable to conceal a portion of each of the front leg and/or the rear leg. The rear leg may include a linear portion extending parallel to the body along the plane. The rear leg may include a curved portion that causes the rear leg to extend nonparallel to the body. At least one of the front leg and the rear leg may be received into a respective one of the slots when the body flexes.

The body or at least a portion thereof may be formed of a resilient material. The body may be operable to flex or bend upon application of a force on any part of the body, e.g., on the at least one of the front leg and the rear leg. The at least one of the front leg and the rear leg may be operable to slide along an angled portion of the end cap upon application of the force on the at least one of the front leg and the rear leg. The tip of the front leg may be operable to abut and slide along the angled portion of the end cap upon application of the force on the front leg. The tip of the front leg may define a planar surface that extends obliquely to an upper surface and a lower surface of the front leg.

The foregoing is intended to be illustrative and is not meant in a limiting sense. Many features of the embodiments may be employed with or without reference to other features of any of the embodiments. Additional aspects, advantages, and/or utilities of the present inventive concept will be set forth in part in the description that follows and, in part, will be apparent from the description, or may be learned by practice of the present inventive concept.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the present inventive concept is not limited to the precise embodiments and features shown. The accompanying drawings, which are incorporated in and constitute a part of this specification, illustrate an implementation of apparatuses consistent with the present inventive concept and, together with the description, serve to explain advantages and principles consistent with the present inventive concept.

DETAILED DESCRIPTION

Figure 1:
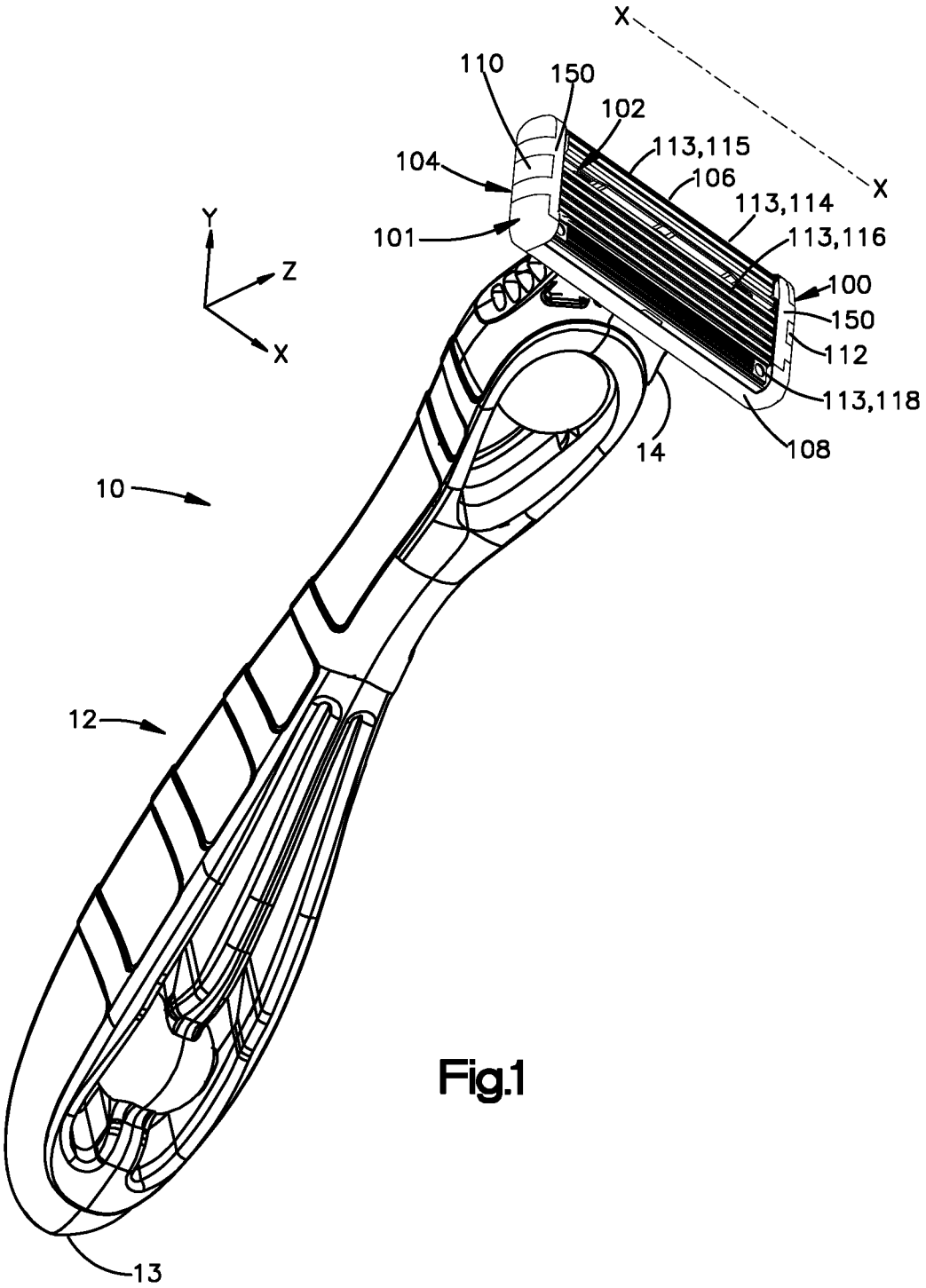
FIG. 1 is a diagram illustrating a perspective view of a shaving razor with a handle and a shaving head.
Figure 2:
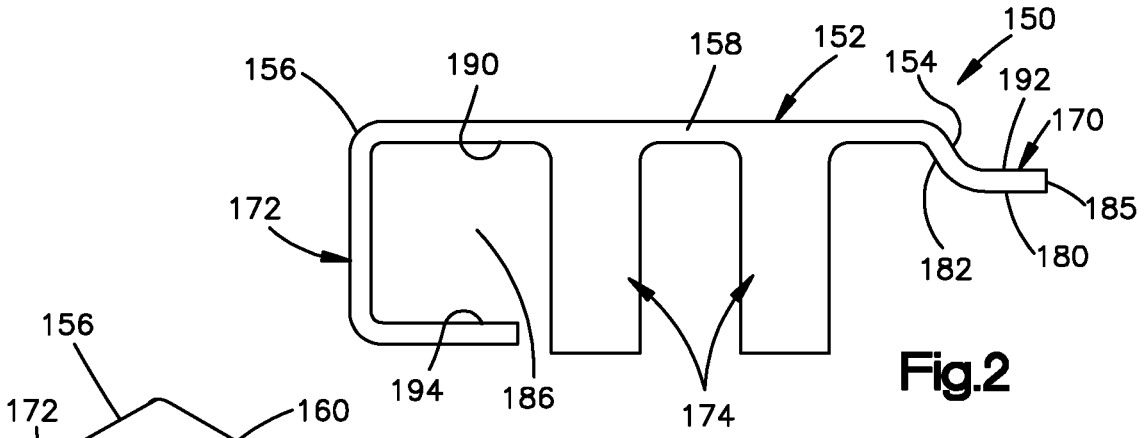
FIG. 2 is a diagram illustrating a side elevation view of a retainer of FIG. 1.

It is to be understood that the present inventive concept is not limited in its application to the details of construction and to the embodiments of the components set forth in the following description or illustrated in the drawings. The figures and written description are provided to teach any person skilled in the art to make and use the inventions for which patent protection is sought. The present inventive concept is capable of other embodiments and of being practiced and carried out in various ways. Persons of skill in the art will appreciate that the development of an actual commercial embodiment incorporating aspects of the present inventive concept will require numerous implementations-specific decisions to achieve the developer's ultimate goal for the commercial embodiment. While these efforts may be complex and time-consuming, these efforts, nevertheless, would be a routine undertaking for those of skill in the art of having the benefit of this disclosure.

I. Terminology

The phraseology and terminology employed herein are for the purpose of description and should not be regarded as limiting. For example, the use of a singular term, such as, "a" is not intended as limiting of the number of items. Also, the use of relational terms such as, but not limited to, "top," "bottom," "left," "right," "upper," "lower," "down," "up," and "side," are used in the description for clarity in specific reference to the figures and are not intended to limit the scope of the present inventive concept or the appended claims. Further, it should be understood that any one of the features of the present inventive concept may be used separately or in combination with other features. Other systems, methods, features, and advantages of the present inventive concept will be, or become, apparent to one with skill in the art upon examination of the figures and the detailed description. It is intended that all such additional systems, methods, features, and advantages be included within this description, be within the scope of the present inventive concept, and be protected by the accompanying claims.

Further, any term of degree such as, but not limited to, "substantially," as used in the description and the appended claims, should be understood to include an exact, or a similar, but not exact configuration. For example, "a substantially planar surface" means having an exact planar surface or a similar, but not exact planar surface. Similarly, the terms "about" or "approximately," as used in the description and the appended claims, should be understood to include the recited values or a value that is three times greater or one third of the recited values. For example, about 1 mm includes all values from 0.1 mm to 9 mm.

Further, as the present inventive concept is susceptible to embodiments of many different forms, it is intended that the present disclosure be considered as an example of the principles of the present inventive concept and not intended to limit the present inventive concept to the specific embodiments shown and described. Any one of the features of the present inventive concept may be used separately or in combination with any other feature. References to the terms "embodiment," "embodiments," and/or the like in the description mean that the feature and/or features being referred to are included in, at least, one aspect of the description. Separate references to the terms "embodiment," "embodiments," and/or the like in the description do not necessarily refer to the same embodiment and are also not mutually exclusive unless so stated and/or except as will be readily apparent to those skilled in the art from the description. For example, a feature, structure, process, step, action, or the like described in one embodiment may also be included in other embodiments, but is not necessarily included. Thus, the present inventive concept may include a variety of combinations and/or integrations of the embodiments described herein. Additionally, all aspects of the present disclosure, as described herein, are not essential for its practice. Likewise, other systems, methods, features, and advantages of the present inventive concept will be, or become, apparent to one with skill in the art upon examination of the figures and the description. It is intended that all such additional systems, methods, features, and advantages be included within this description, be within the scope of the present inventive concept, and be encompassed by the claims.

Lastly, the terms "or" and "and/or," as used herein, are to be interpreted as inclusive or meaning any one or any combination. Therefore, "A, B or C" or "A, B and/or C" mean any of the following: "A," "B," "C"; "A and B"; "A and C"; "B and C"; "A, B and C." An exception to this definition will occur only when a combination of elements, functions, steps or acts are in some way inherently mutually exclusive.

II. General Architecture

Turning to FIGS. 1-5, a shaving razor 10 is illustrated, which includes a handle 12 coupled with a shaving head 100. The handle 12 extends in a handle direction between a proximal end 13 and a distal end 14. The shaving head 100 is coupled with the distal end 14 of the handle 12. In at least one example, the shaving head 100 may be removably coupled with the handle 12, for example, by a lock and release mechanism. In other examples, the shaving head 100 may be fixedly coupled with the handle 12 such that the shaving head 100 is not configured to be removably coupled with or selectively separated from the handle 12. The shaving head 100 may be operable to pivot relative to the handle 12. In other examples, the handle 12 may be secured to the shaving head 100 in a fixed relationship such that the handle 12 is not operable to pivot relative to the shaving head 100. The handle 12 may be any suitable shape to allow a user to securely grip the handle 12. It is foreseen that the handle 12 may include one continuous curve or include one straight portion or several curved and/or straight portions extending along an entirety of or a substantial portion of the handle 12 without deviating from the scope of the present inventive concept.

The shaving head 100 includes a housing 101. The housing 101 extends along a longitudinal axis X-X. The housing 101, as illustrated, has a substantially rectangular shape, but may be any suitable shape such as ovoid or circular without deviating from the scope of the present inventive concept. The shaving head 100 and the housing 101 include a top side 102 and a bottom side 104 opposite the top side 102. The bottom side 104 is proximate to the handle 12, and the top side 102 includes at least one skin contacting area. The housing 101 includes first and second longitudinal walls 106, 108. Each of the first and second longitudinal walls 106, 108 extends longitudinally along the longitudinal axis X-X between the top and bottom sides 102, 104 and in a direction Z of the housing 101. The first and second longitudinal walls 106, 108 extend parallel to each other. First and second side walls 110, 112 extend parallel to each other and between the first and second longitudinal walls 106, 108 along a direction Y of the housing 101. The first and second side walls 110, 112 also extend between the top and bottom sides 102, 104 along the direction Z of the housing 101. The housing 101 may be made of plastic, metal, another suitable material, or any combination thereof without deviating from the scope of the present inventive concept.

The shaving head 100 includes a plurality of shaving head components 113 which assist and contribute to the shaving experience of the user. One of the plurality of shaving head components 113 is a plurality of blades 116 disposed and retained within the housing 101. The blades 116 extend along the longitudinal axis X-X. In at least one example, the shaving head 100 can include one, two, three, four, or more of the blades 116 without deviating from the scope of the present inventive concept. The blades 116 may be movably disposed or freely mounted, in the housing 101. For example, the blades 116 may be coupled with elastic fingers which extend from the housing 101. In other examples, the blades 116 may be fixedly disposed in the housing 101.

The plurality of shaving head components 113 also include a cap 114, a lubricating strip 115, and a guard bar 118 on and/or retained within the shaving head 100. The cap 114 is coupled with the first longitudinal wall 106. The lubricating strip 115 is disposed on the top side 102 of the cap 114 to deliver a friction reduction effect and/or an anti-irritation effect, and/or provide lubrication to skin of the user after the skin contacts the blades 116, thereby providing a smoother shave to the user. The guard bar 118 is coupled with the second longitudinal wall 108 opposite the cap 114 to stretch the skin during shaving or dispense forces applied to the skin during shaving, thereby causing the shaving head 100 to glide across the skin while providing a closer shave. The cap 114, the lubricating strip 115, and the guard bar 118 each extend along the longitudinal axis X-X. Additional components, e.g., a cover and/or one or more trimming blades, may also be included on and retained within the shaving head 100 without deviating from the scope of the present inventive concept.

The plurality of shaving head components 113 is retained within the shaving head 100 by retainers 150. For example, the retainers 150 are operable to retain the blades 116, the cap 114, the lubricating strip 115, and the guard bar 118 within the shaving head 100. The retainers 150 are installed on a respective one of the side walls 110, 112 of the housing 101. It is foreseen that the retainers 150 may be installed in other walls or only one of the side walls 110, 112 of the housing 101 as desired without deviating from the scope of the present inventive concept. As illustrated, the retainers 150 retain the plurality of shaving head components 113 by securely abutting and partially covering (i) a portion of the components, e.g., lateral sides or sides along the direction X of the components, and (ii) the side walls 110, 112. It is foreseen that the retainers 150 may be operable to secure one or more other components within or on the shaving head 100 without deviating from the scope of the present inventive concept. It is also foreseen that any one or more of the plurality of shaving head components 113 may be secured to the shaving head 100 without or in coordination with the retainers 150, e.g., using other securing means such as welding, adhesive or the like, without deviating from the scope of the present inventive concept.

The retainers 150 may be made of a resilient material such as plastic, metal, or other similar material or any combination thereof without deviating from the scope of the present inventive concept. Each of the retainers 150 include a central retainer body 152 that is generally flat and extends along a single plane in first and second directions. It is foreseen, however, that the retainer body 152 may be concave or convex without deviating from the scope of the present inventive concept. For instance, if the retainer body 152 is convex, such will cause a middle one or ones of the blades 116 to have a lower exposure compared to outer ones of the blades 116. Conversely, if the retainer body 152 is concave, such will cause a middle one or ones of the blades 116 to have a higher exposure compared to outer ones of the blades 116. Such convex and concave designs of the retainer body 152 each provides an exposure range of −100 μm to 150 μm and more preferably an exposure range of −50 μm to 100 μm. The retainer body 152 includes a front 154 extending toward and facing a front of the shaving head 100, a rear 156 extending toward and facing a rear of the shaving head 100, an exterior side 158 extending toward and facing an exterior side of the shaving head 100, and an interior side 160 extending toward and facing an interior side of the shaving head 100.

The retainer body 152 includes a front leg 170 extending from the front 154 of the retainer body 152, a rear leg 172 extending from the rear 156 of the retainer body 152, and a plurality of side legs 174 extending from the exterior side 158 of the retainer body 152. It is foreseen that the retainer body 152 could include only one of the plurality of side legs 174 or include none of the plurality of side legs 174 without deviating from the scope of the present inventive concept. For instance, if only one of the plurality of side legs 174 is utilized, it is foreseen that the one side leg may depend from the retainer body 152 in an off-centered configuration, i.e., spaced from a center of the retainer body 152, so that the one side leg facilitates locating and positioning of the retainer 150 on the shaving head 100 without deviating from the scope of the present inventive concept. It is also foreseen that the retainer body 152 could include a plurality of front legs and/or a plurality of rear legs or could include no front leg and/or no rear leg without deviating from the scope of the present inventive concept.

The front leg 170 and the rear leg 172 extend, at least partially, parallel to each other along the single plane defined by the retainer body 152. The front leg 170 includes a linear portion 180 extending parallel to the retainer body 152. The front leg 170 further includes a curved portion 182 that causes the front leg 170 to extend nonparallel to the retainer body 152. The curved portion 182 of the front leg 170 extends between the retainer body 152 and the linear portion 180 of the front leg 170. The linear portion 180 of the front leg 170 extends into and is received by a slot 184 of the shaving head 100 such that a tip 185 of the front leg 170 and a substantial portion of the linear portion 180 of the front leg 170 are housed within the slot 184. The linear portion 180 of the front leg 170 is about 1.0 mm long and 0.5 mm wide and the slot 184 is about 1.05 mm long and about 0.45 mm wide. The rear leg 172 and the side legs 174 extend (i) at least partially parallel to each other, (ii) at least partially nonparallel to the retainer body 152, and (iii) at least partially parallel to the retainer body 152 with the tip 185 of the front leg 170 defining an outermost point of the retainer 150 in the first direction and along the single plane defined by the retainer body 152. In this manner, the retainer body 152, the rear leg 172, and the side legs 174 define and partially surround an interior cavity 186. It is foreseen that entireties of the front leg 170 and the rear leg 172 may extend parallel to each other along a single plane and depend from the retainer body 152 at an angle thereto without deviating from the scope of the present inventive concept. For instance, the curved portion 182 and the linear portion 180 of the front leg 170 may depend from the plane defined by the retainer body 152 at an angle of between 100 degrees and 150 degrees. Alternatively, the linear portion 180 may be curved, e.g., upward or downward relative to the curved portion 182 of the front leg 170 without deviating from the scope of the present inventive concept. Further, it is foreseen that an entirety of the rear leg 172 may be concave without any linear portion, thereby defined by a single radius or a plurality of radii without deviating from the scope of the present inventive concept.

The retainer body 152 includes an interior abutment surface 190 on an interior side of the retainer body 152 that faces toward the interior cavity 186. The interior abutment surface 190 of the retainer body 152 is operable to abut one or more of the plurality of shaving head components 113. The linear portion 180 of the front leg 170 includes an exterior abutment surface 192 on an exterior side of the front leg 170 that faces away from the interior cavity 186. The exterior abutment surface 192 of the front leg 170 is operable to abut an internal surface of the slot 184. The rear leg 172 includes an interior abutment surface 194 on an interior side of the rear leg 172 that faces toward the interior cavity 186. The interior abutment surface 194 of the rear leg 172 is operable to abut the bottom side 104 of the shaving head 100. Each of the side legs 174 includes an interior abutment surface 196 on an interior side of each of the side legs 174 that faces toward the interior cavity 186. The interior abutment surface 196 of each of the side legs 174 is operable to abut the bottom side 104 of the shaving head 100. The rear leg 172 abuts and partially surrounds a portion of the second longitudinal wall 108 and abuts the bottom side 104 of the shaving head 100. Each of the side legs 174 (i) abut and partially surround a respective one of the first side wall 110 and the second side wall 112, and (ii) abut the bottom side 104 of the shaving head 100. In this manner, the retainer body 152 and the legs 170, 172, 174 cooperatively secure the one or more of the plurality of shaving head components 113 on or within the shaving head 100.

Figure 4:
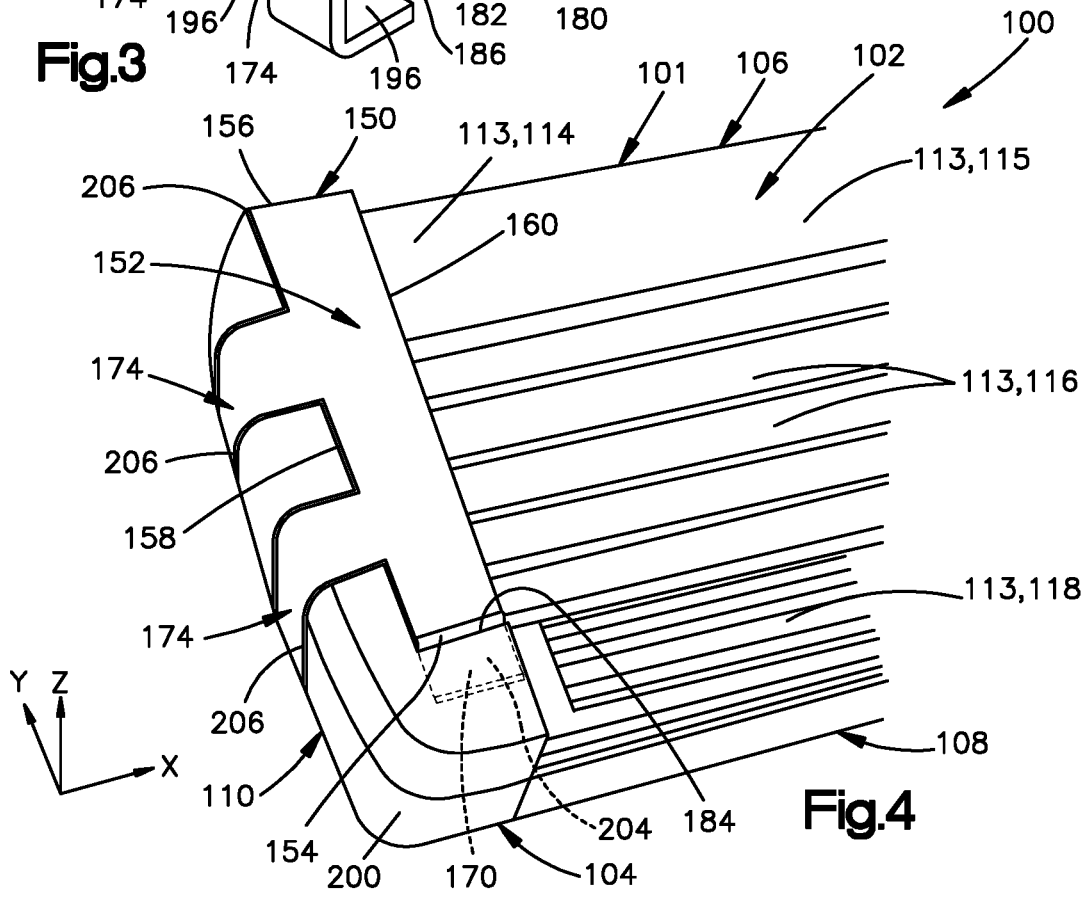
FIG. 4 is a diagram illustrating a perspective view of a shaving head of FIG. 1.
Figure 5:
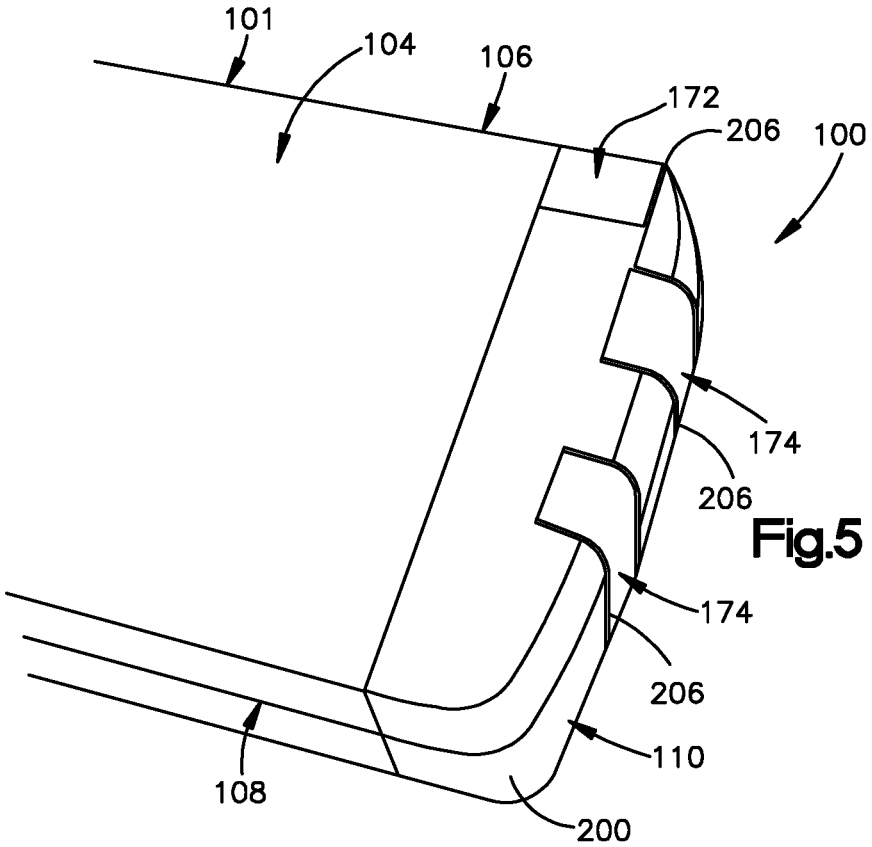
FIG. 5 is a diagram illustrating a perspective view of the shaving head of FIG. 4.

The slot 184 is defined by an end cap 200 on each of the side walls 110, 112 of the shaving head 100 and is spaced from the each of the side walls 110, 112 as illustrated by FIGS. 4 and 5. It is foreseen, however, that each of the slots 184 may extend up to its respective one of the side walls 110, 112 with the legs 172, 174 preformed prior to assembly with a notch on one or more of the interior abutment surfaces 194, 196 without deviating from the scope of the present inventive concept. The slot 184 is positioned adjacent to the second longitudinal wall 108, and includes an upper interior surface 204 operable to abut the exterior abutment surface 192 of the front leg 170. It is foreseen, however, that the entire design of the retainer 150 could be reversed with the slot 184 positioned adjacent to the first longitudinal wall 106 or the cap 114 without deviating from the scope of the present inventive concept. The end cap 200 further includes a plurality of grooves 206 operable to receive the legs 172, 174, with the legs 172, 174 entirely nested within the grooves 206 such that outermost surfaces of the legs 172, 174 are flush with an outermost surface of the end cap 200. In this manner, the grooves 206 prevent movement of the retainer 150 relative to the housing 101 after the retainer 150 has been installed on the shaving head 100.

Figure 3:
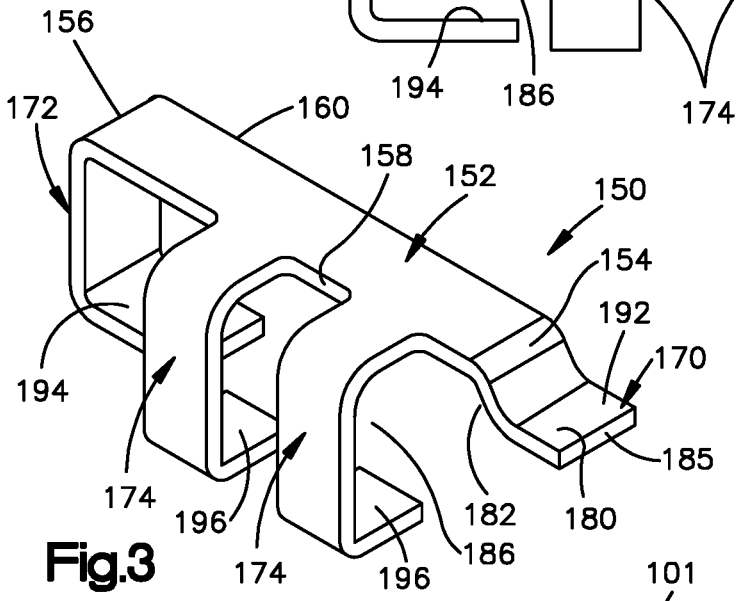
FIG. 3 is a diagram illustrating a perspective view of a retainer of FIG. 2.

Prior to assembly of the shaving head 100, the rear leg 172 of each of the retainers 150 is in a bent configuration, i.e., an original configuration or "unloaded" configuration, as illustrated by FIG. 3, with each of the legs 174 in an unbent configuration. The resilient nature of the material of the retainers 150 causes the retainers 150, once installed or loaded onto the housing 101, i.e., a "loaded" configuration, to impart a pressure on the housing 101. To secure the retainers 150 to the housing 101, the linear portion 180 of the front leg 170 of each of the retainers 150 is guided or slid into the slot 184 on each of the end caps 200. Next, the rear leg 172 of each of the retainers 150 is flexibly expanded from the unloaded configuration and beyond the loaded configuration, positioned so that the end cap 200 is within the interior cavity 186, and released so that the rear legs 172 are nested into the grooves 206. Upon release of the rear legs 172, the resilient nature of the material of the retainers 150 causes the retainers 150 to be biased toward the unloaded configuration. The end caps 200 prevent the retainers 150 from completely returning to the unloaded configuration and cause the rear legs 172 of each of the retainers 150 to be displaced a distance from the unloaded configuration and maintained in the loaded configuration. Finally, the side legs 174 are bent so that each of the side legs 174 nest within a respective one of the grooves 206. In this manner, the retainers 150 secure the components 113 onto the shaving head 100. It is foreseen that one or more of the legs 172, 174 could include a hook or anchor operable to mate with a corresponding loop or fastener on the shaving head 100, thereby allowing omission of one or more of the interior abutment surfaces 194, 196 without deviating from the scope of the present inventive concept.

Turning to FIGS. 6-9, another embodiment of the present inventive concept is illustrated with a shaving head 300. Similar to the embodiment illustrated in FIGS. 1-5 with shaving head 100, the shaving head 300 is operable to be coupled with the distal end 14 of the handle 12 and includes a housing 301. The housing 301 extends along a longitudinal axis X-X. The housing 301, as illustrated, has a substantially rectangular shape, but may be any suitable shape such as ovoid or circular without deviating from the scope of the present inventive concept. The shaving head 300 and the housing 301 include a top side 302 and a bottom side 304 opposite the top side 302. The bottom side 304 is proximate to the handle 12, and the top side 302 includes at least one skin contacting area. The housing 301 includes first and second longitudinal walls 306, 308. Each of the first and second longitudinal walls 306, 308 extends longitudinally along the longitudinal axis X-X between the top and bottom sides 302, 304 and in a direction Z of the housing 301. The first and second longitudinal walls 306, 308 extend parallel to each other. As with the first and second side walls 110, 112, a first side wall 310 and a second side wall extend parallel to each other and between the first and second longitudinal walls 306, 308 along a direction Y of the housing 301. The first side wall 310 and the second side wall also extend between the top and bottom sides 302, 304 along the direction Z of the housing 301. The housing 301 may be made of plastic, metal, another suitable material, or any combination thereof without deviating from the scope of the present inventive concept.

The shaving head 300 includes a plurality of shaving head components 313 which assist and contribute to the shaving experience of the user. One of the components 313 is a plurality of blades 316 disposed and retained within the housing 301. The blades 316 extend along the longitudinal axis X-X. In at least one example, the shaving head 300 can include one, two, three, four, or more of the blades 316 without deviating from the scope of the present inventive concept. The blades 316 may be movably disposed or freely mounted, in the housing 301. For example, the blades 316 may be coupled with elastic fingers which extend from the housing 301. In other examples, the blades 316 may be fixedly disposed in the housing 301.

The plurality of shaving head components 313 also include a cap 314, a lubricating strip 315, and a guard bar 318 on and/or retained within the shaving head 300. Additional components, e.g., a cover and/or one or more trimming blades, may also be included on and retained within the shaving head 300 without deviating from the scope of the present inventive concept.

The plurality of shaving head components 313 is retained within the shaving head 300 by retainers 350. For example, the retainers 350 are operable to retain the blades 316, the cap 314, the lubricating strip 315, and the guard bar 318 within the shaving head 300. The retainers 350 are installed on a respective one of the first side wall 310 and the second side wall of the housing 301. It is foreseen that the retainers 350 may be installed in other walls or only one of the first side wall 310 and the second side wall of the housing 301 as desired without deviating from the scope of the present inventive concept. As illustrated, the retainers 350 retain the components 313 by securely abutting and partially covering (i) a portion of the components 313, e.g., lateral sides or sides along the direction X of the components 313, and (ii) the first side wall 310 and the second side wall of the housing 301. It is foreseen that the retainers 350 may be operable to secure one or more other components 313 within or on the shaving head 300 without deviating from the scope of the present inventive concept. It is also foreseen that any one or more of the components 313 may be secured to the shaving head 300 without the retainers 350, e.g., via other means, without deviating from the scope of the present inventive concept.

The retainers 350 may be made of a resilient material such as plastic, metal, or other similar material or any combination thereof without deviating from the scope of the present inventive concept. Each of the retainers 350 include a central retainer body 352 that is generally flat and extends along a single plane in first and second directions. The retainer body 352 includes a front 354 extending toward and facing a front of the shaving head 300, a rear 356 extending toward and facing a rear of the shaving head 300, an exterior side 358 extending toward and facing an exterior side of the shaving head 300, and an interior side 360 extending toward and facing an interior side of the shaving head 300.

The retainer body 352 includes a front leg 370 extending from the front 354 of the retainer body 352 and a rear leg 372 extending from the rear 356 of the retainer body 352. It is foreseen that the retainer body 352 could include only one or more side legs extending from the exterior side 358 of the retainer body 352 without deviating from the scope of the present inventive concept.

The front leg 370 and the rear leg 372 extend, at least partially, parallel to each other along the single plane defined by the retainer body 352. The front leg 370 includes a linear portion 380 extending parallel to the retainer body 352. The front leg 370 further includes a curved portion 382 that causes the front leg 370 to extend nonparallel to the retainer body 352. The curved portion 382 of the front leg 370 extends between the retainer body 352 and the linear portion 380 of the front leg 370. The linear portion 380 of the front leg 370 extends into and is received by a slot 384 of the shaving head 300 such that a tip 385 of the front leg 370 and a substantial portion of the linear portion 380 of the front leg 370 are housed within the slot 384. The linear portion 380 of the front leg 370 is about 1.0 mm long and about 0.5 mm wide and the slot 384 is about 1.05 mm long and about 0.45 mm wide. The rear leg 372 extends (i) at least partially nonparallel to the retainer body 352, and (ii) at least partially parallel to the retainer body 352 with the tip 385 of the front leg 370 defining an outermost point of the retainer 350 in the first direction and along the single plane defined by the retainer body 352. In this manner, the retainer body 352 and the rear leg 372 define and partially surround an interior cavity 386.

The retainer body 352 includes an interior abutment surface 390 on an interior side of the retainer body 352 that faces toward the interior cavity 386. The interior abutment surface 390 of the retainer body 352 is operable to abut one or more of the plurality of shaving head components 313. The linear portion 380 of the front leg 370 includes an exterior abutment surface 392 on an exterior side of the front leg 370 that faces away from the interior cavity 386. The exterior abutment surface 392 of the front leg 370 is operable to abut an internal surface of the slot 384. The rear leg 372 includes an interior abutment surface 394 on an interior side of the rear leg 372 that faces toward the interior cavity 386. The interior abutment surface 394 of the rear leg 372 is operable to abut the bottom side 304 of the shaving head 300. The rear leg 372 abuts and partially surrounds a portion of the second longitudinal wall 308 and abuts the bottom side 304 of the shaving head 300. In this manner, the retainer body 352 and the legs 370, 372 cooperatively secure the one or more of the plurality of shaving head components 313 on or within the shaving head 300.

The slot 384 is defined by an end cap 400 on each of the first side wall 310 and the second side wall of the shaving head 300. The slot 384 is positioned adjacent to the second longitudinal wall 308 and includes an upper interior surface 404 operable to abut the exterior abutment surface 392 of the front leg 370. The end cap 400 further includes a groove 406 operable to receive the leg 372, with the leg 372 entirely nested within the groove 406 such that an outermost surface of the leg 372 is flush with an outermost surface of the end cap 400. In this manner, the groove 406 prevents movement of the retainer 350 relative to the housing 301 after the retainer 350 has been installed on the shaving head 300.

Figure 6:
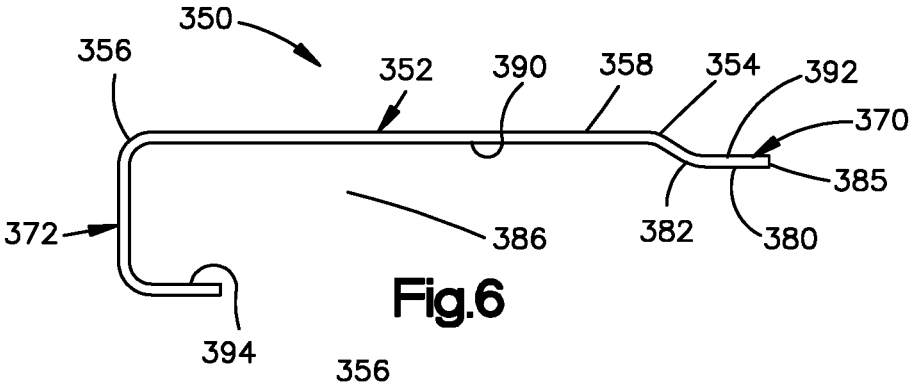
FIG. 6 is a diagram illustrating a side elevation view of another retainer.
Figure 7:
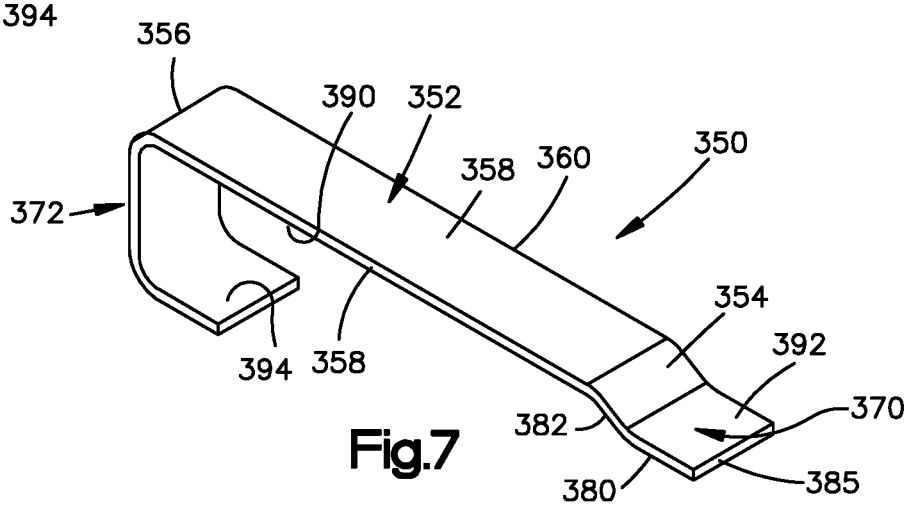
FIG. 7 is a diagram illustrating a perspective view of the retainer of FIG. 6.
Figure 8:
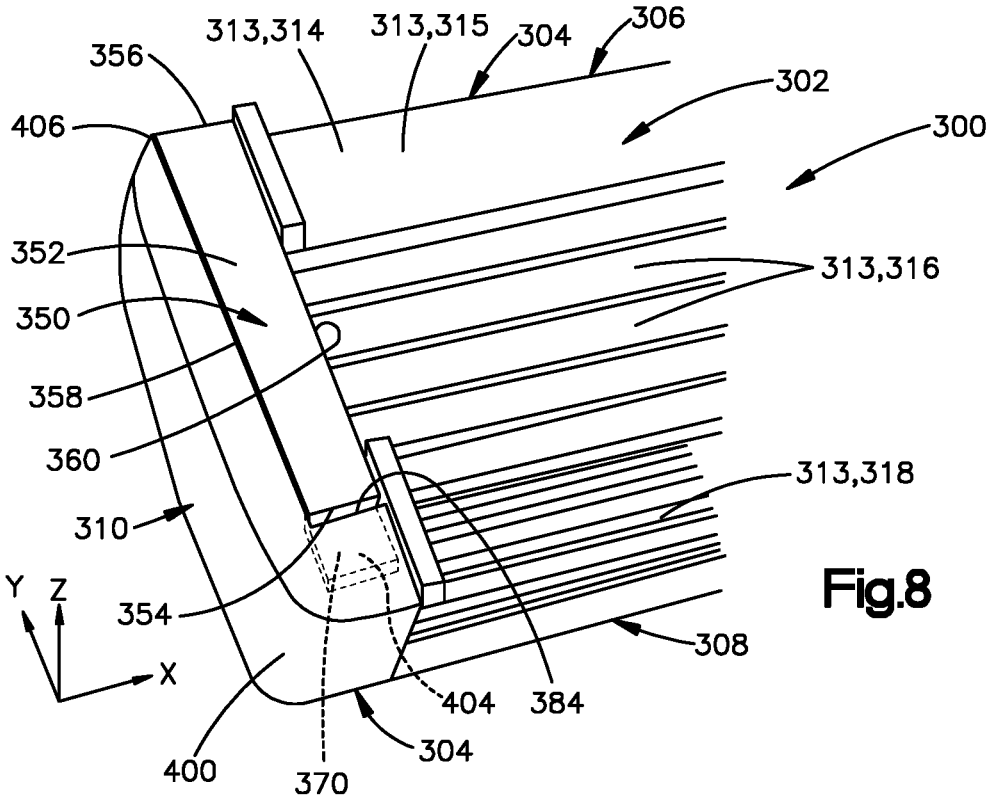
FIG. 8 is a diagram illustrating a perspective view of a shaving head with the retainer of FIG. 6.
Figure 9:
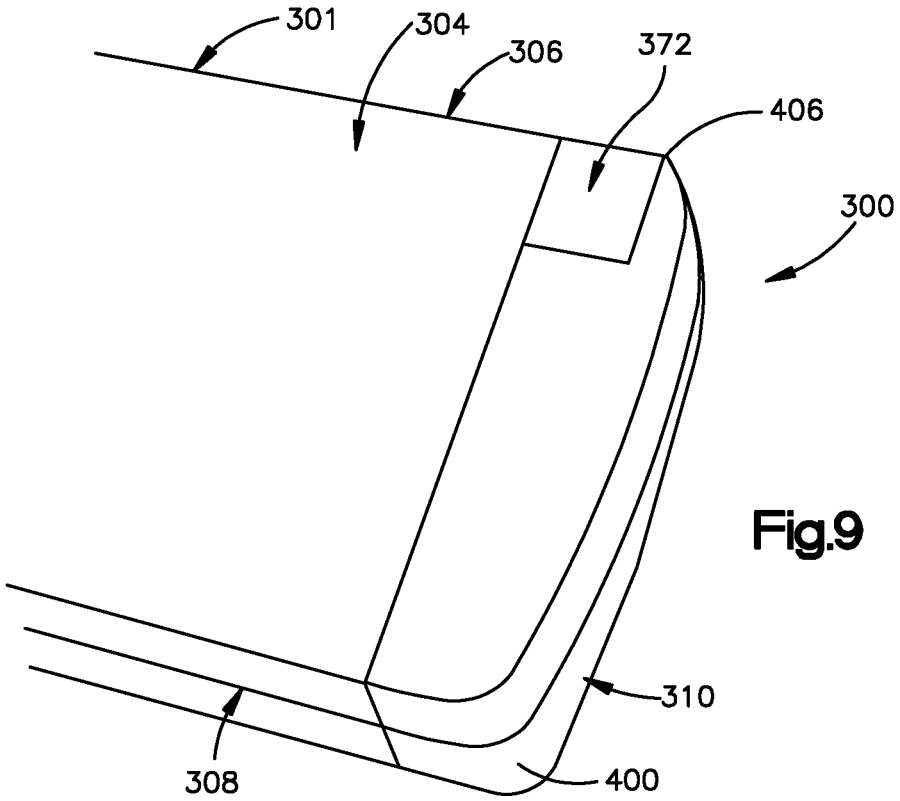
FIG. 9 is a diagram illustrating a perspective view of the shaving head of FIG. 8.

Prior to assembly of the shaving head 300, the leg 372 of each of the retainers 350 is in a bent configuration, i.e., an original configuration or "unloaded" configuration as illustrated by FIG. 6. The resilient nature of the material of the retainers 350 causes the retainers 350, once installed or loaded onto the housing 301, i.e., a "loaded" configuration, to impart a pressure on the housing 301. To secure the retainers 350 to the housing 101, the linear portion 380 of the front leg 370 of each of the retainers 350 is guided or slid into the slot 384 on each of the end caps 300. Next, the leg 372 is flexibly expanded from the unloaded configuration and beyond the loaded configuration, positioned so that the end cap 300 is within the interior cavity 386, and released so that the leg 372 is nested into the groove 406. Upon release of the leg 372, the resilient nature of the material of the retainers 350 causes the retainers 350 to be biased toward the unloaded configuration. The end caps 300 prevent the retainers 350 from completely returning to the unloaded configuration and cause the leg 372 of each of the retainers 350 to be displaced a distance from the unloaded configuration and maintained in the loaded configuration. In this manner, the retainers 350 secure the components 313 onto the shaving head 300.

Figure 10:
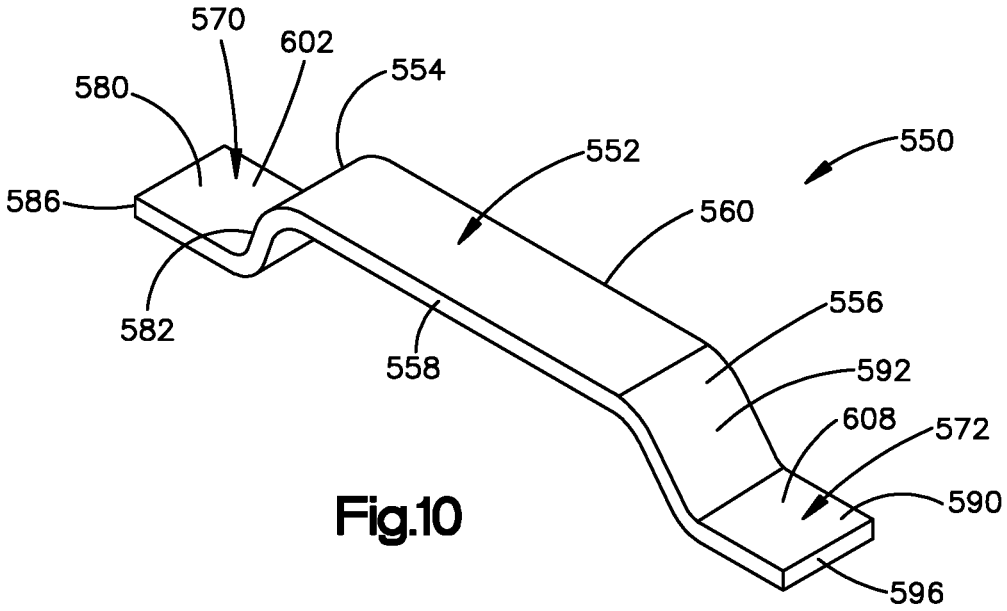
FIG. 10 is a diagram illustrating a perspective view of another retainer.
Figure 11:
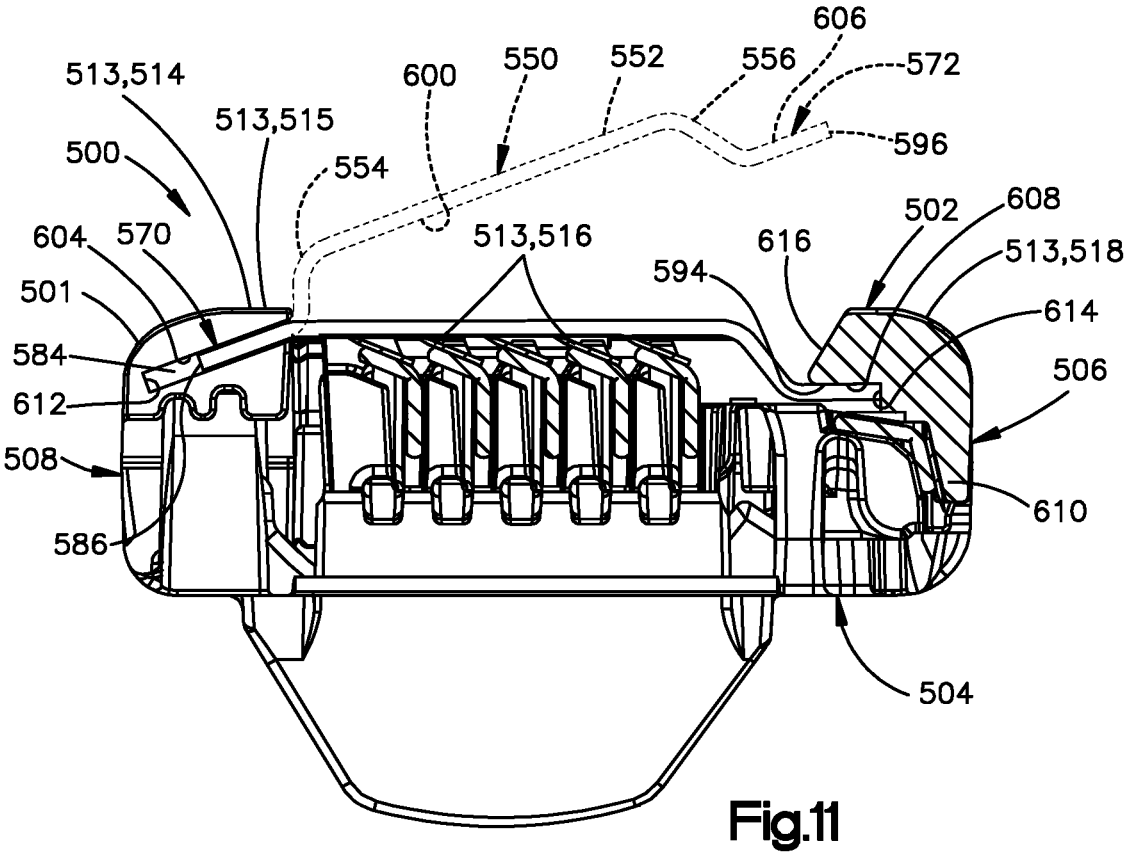
FIG. 11 is a diagram illustrating a cross-sectional view of a shaving head with the retainer of FIG. 10.
Figure 12:
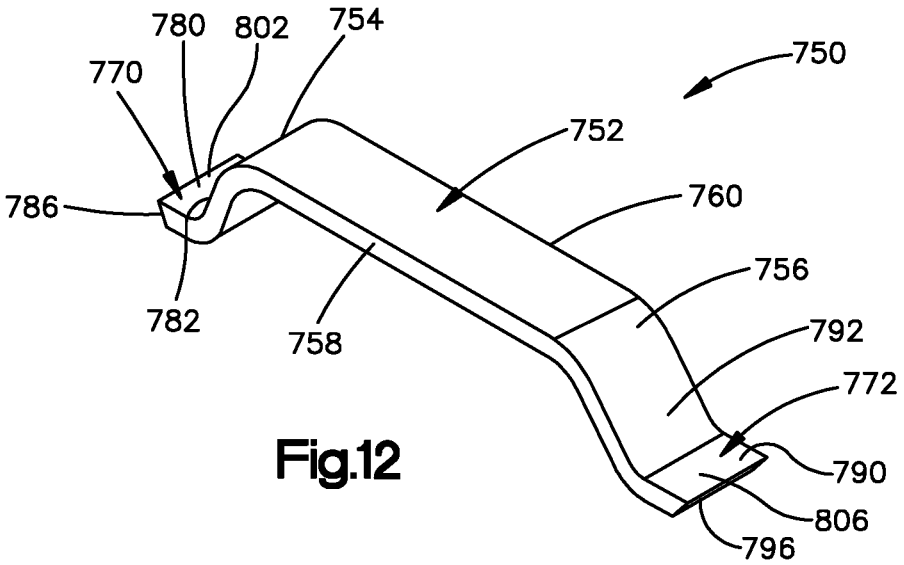
FIG. 12 is a diagram illustrating a perspective view of another retainer.
Figure 13:
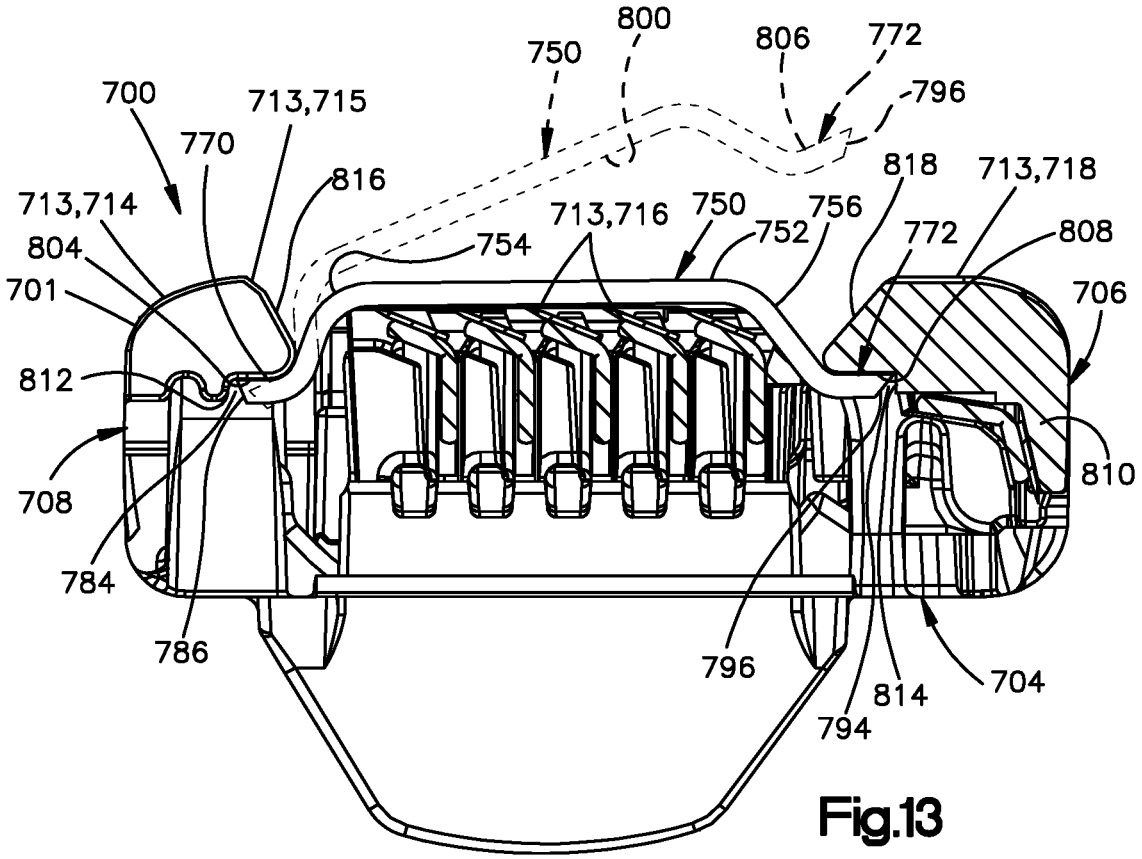
FIG. 13 is a diagram illustrating a cross-sectional view of a shaving head with the retainer of FIG. 12.
Figure 14:
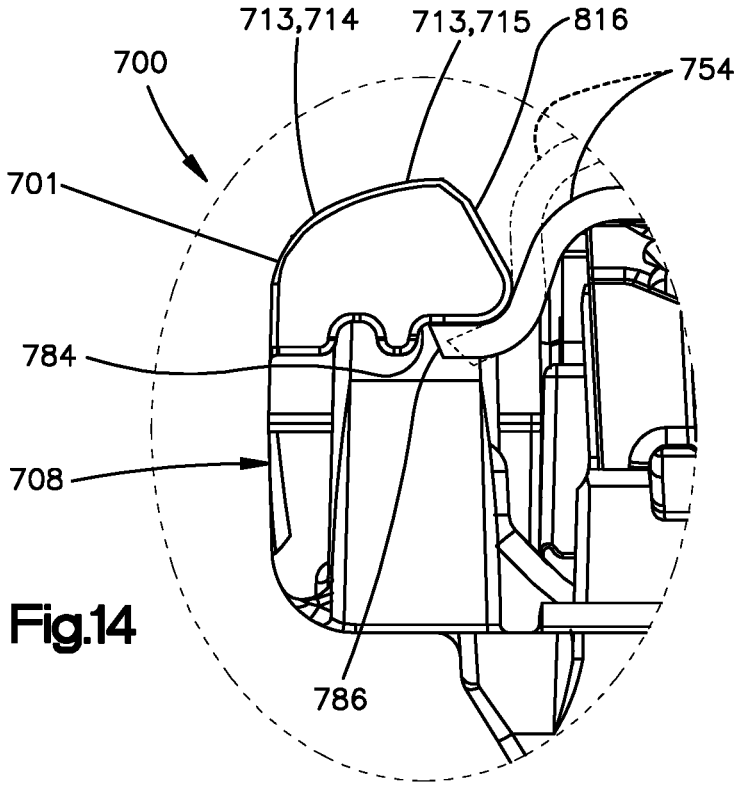
FIG. 14 is a diagram illustrating a magnified view of the shaving head of FIG. 13.
Figure 15:
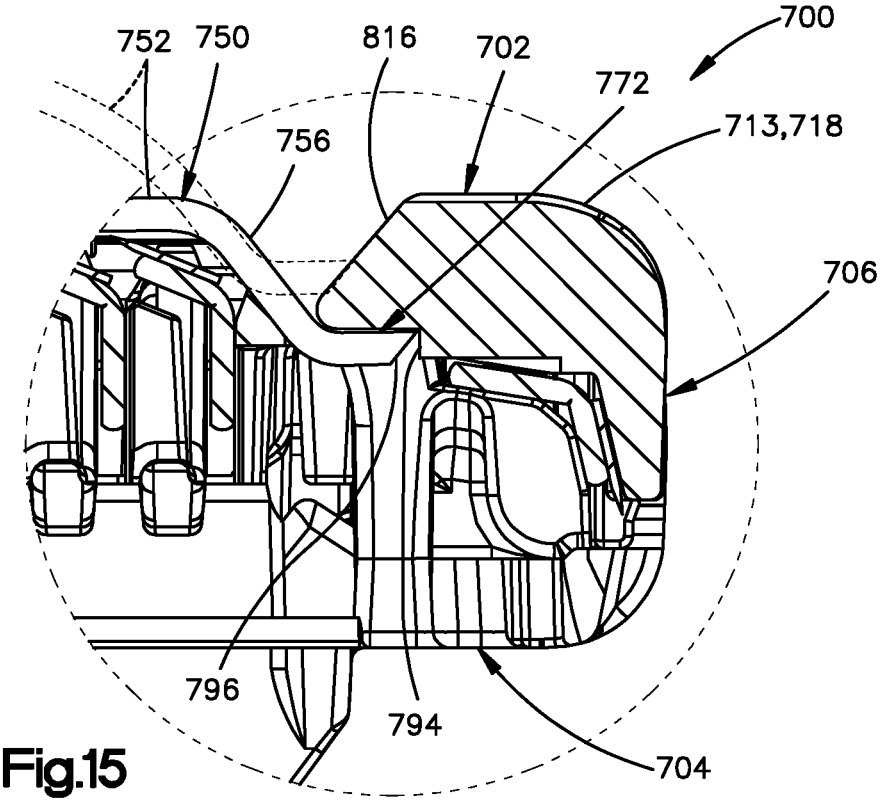
FIG. 15 is a diagram illustrating a magnified view of the shaving head of FIG. 13.

Turning to FIGS. 10 and 11, another embodiment of the present inventive concept is illustrated with a shaving head 500. Similar to the embodiment illustrated in FIGS. 1-5 with shaving head 100 and in FIGS. 6-9 with shaving head 300, the shaving head 500 is operable to be coupled with the distal end 14 of the handle 12 and includes a housing 501. The housing 501 extends along a longitudinal axis X-X. The housing 501, as illustrated, has a substantially rectangular shape, but may be any suitable shape such as ovoid or circular without deviating from the scope of the present inventive concept. The shaving head 500 and the housing 501 include a top side 502 and a bottom side 504 opposite the top side 502. The bottom side 504 is proximate to the handle 12, and the top side 502 includes at least one skin contacting area. The housing 501 includes first and second longitudinal walls 506, 508. Each of the first and second longitudinal walls 506, 508 extends longitudinally along the longitudinal axis X-X between the top and bottom sides 502, 504 and in a direction Z of the housing 501. The first and second longitudinal walls 506, 508 extend parallel to each other. As with the first and second side walls 110, 112, first and second side walls extend parallel to each other and between the first and second longitudinal walls 506, 508 along a direction Y of the housing 501. The first and second side walls also extend between the top and bottom sides 502, 504 along the direction Z of the housing 501. The housing 501 may be made of plastic, metal, another suitable material, or any combination thereof without deviating from the scope of the present inventive concept.

The shaving head 500 includes a plurality of shaving head components 513 which assist and contribute to the shaving experience of the user. One of the components 513 is a plurality of blades 516 disposed and retained within the housing 501. The blades 516 extend along the longitudinal axis X-X. In at least one example, the shaving head 500 can include one, two, three, four, or more of the blades 516 without deviating from the scope of the present inventive concept. The blades 516 may be movably disposed or freely mounted, in the housing 501. For example, the blades 516 may be coupled with elastic fingers which extend from the housing 501. In other examples, the blades 516 may be fixedly disposed in the housing 501.

The plurality of shaving head components 513 also include a cap 514, a lubricating strip 515, and a guard bar 518 on and/or retained within the shaving head 500. Additional components, e.g., a cover and/or one or more trimming blades, may also be included on and retained within the shaving head 500 without deviating from the scope of the present inventive concept.

A plurality of components 513 is retained within the shaving head 500 by retainers 550. For example, the retainers 550 are operable to retain the blades 516, the cap 514, the lubricating strip 515, and the guard bar 518 within the shaving head 500. The retainers 550 are installed on a respective one of the side walls of the housing 501. It is foreseen that the retainers 550 may be installed in other walls or only one of the side walls of the housing 501 as desired without deviating from the scope of the present inventive concept. As illustrated, the retainers 550 retain the components 513 by securely abutting and partially covering (i) a portion of the components 513, e.g., lateral sides or sides along the direction X of the components 513, and (ii) the side walls. It is foreseen that the retainers 550 may be operable to secure one or more other components 513 within or on the shaving head 500 without deviating from the scope of the present inventive concept. It is also foreseen that any one or more of the components 513 may be secured to the shaving head 500 without the retainers 550, e.g., via other means, without deviating from the scope of the present inventive concept.

The retainers 550 may be made of a resilient material such as plastic, metal, or other similar material or any combination thereof without deviating from the scope of the present inventive concept. Each of the retainers 550 include a central retainer body 552 that is generally flat and extends along a single plane in first and second directions. The retainer body 552 includes a front 554 extending toward and facing a front of the shaving head 500, a rear 556 extending toward and facing a rear of the shaving head 500, an exterior side 558 extending toward and facing an exterior side of the shaving head 500, and an interior side 560 extending toward and facing an interior side of the shaving head 500.

The retainer body 552 includes a front leg 570 extending from the front 554 of the retainer body 552 and a rear leg 572 extending from the rear 556 of the retainer body 552. It is foreseen that the retainer body 552 could include only one or more side legs extending from the exterior side 558 of the retainer body 552 without deviating from the scope of the present inventive concept.

The front leg 570 and the rear leg 572 extend, at least partially, parallel to each other along the single plane defined by the retainer body 552. The front leg 570 includes a linear portion 580 extending parallel to the retainer body 552. The front leg 570 further includes a curved portion 582 that causes the front leg 570 to extend nonparallel to the retainer body 552. The curved portion 582 of the front leg 570 extends between the retainer body 552 and the linear portion 580 of the front leg 570. The linear portion 580 of the front leg 570 extends into and is received by a front slot 584 adjacent to the second longitudinal wall 508 of the shaving head 500 such that a tip 586 of the front leg 570 and a substantial portion of the linear portion 580 of the front leg 570 are housed within the front slot 584, and the tip 586 defines an outermost point of the retainer 550 in the first direction and along the single plane defined by the retainer body 552. The linear portion 580 of the front leg 570 is about 1.0 mm long and about 0.5 mm wide and the front slot 584 is about 1.05 mm long and about 0.45 mm wide.

The rear leg 572 includes a linear portion 590 extending parallel to the retainer body 552. The rear leg 572 further includes a curved portion 592 that causes the rear leg 572 to extend nonparallel to the retainer body 552. The curved portion 592 of the rear leg 572 extends between the retainer body 552 and the linear portion 590 of the rear leg 572. The linear portion 590 of the rear leg 572 extends into and is received by a rear slot 594 adjacent to the second longitudinal wall 506 of the shaving head 500 such that a tip 596 of the rear leg 572 and a substantial portion of the linear portion 590 of the rear leg 572 are housed within the rear slot 594, and the tip 596 defines an outermost point of the retainer 550 in the second direction and along the single plane defined by the retainer body 552. The linear portion 590 of the rear leg 572 is about 1.0 mm long and about 0.5 mm wide and the rear slot 594 is about 1.05 mm long and about 0.45 mm wide.

The retainer body 552 includes an interior abutment surface 600 on an interior side of the retainer body 552 that faces toward the bottom side 504 of the shaving head 500. The interior abutment surface 600 of the retainer body 552 is operable to abut one or more of the plurality of shaving head components 513. The linear portion 580 of the front leg 570 includes an exterior abutment surface 602 on an exterior side of the front leg 570 that faces away from the bottom side 504 of the shaving head 500. The exterior abutment surface 602 of the front leg 570 is operable to abut a front upper interior surface 604 of the front slot 584. The linear portion 590 of the rear leg 572 includes an exterior abutment surface 606 on an exterior side of the rear leg 572 that faces away from the bottom side 504 of the shaving head 500. The exterior abutment surface 606 of the rear leg 572 is operable to abut a rear upper interior surface 608 of the rear slot 594. In this manner, the retainer body 552 and the legs 570, 572 cooperatively secure the one or more of the plurality of shaving head components 513 on or within the shaving head 500.

The slots 584, 594 are defined by an end cap 610 on each of the side walls of the shaving head 500. The front slot 584 is positioned adjacent to the second longitudinal wall 508 and includes an interior end surface 612 that is spaced from the tip 586 of the front leg 570. The rear slot 594 is positioned adjacent to the first longitudinal wall 506 and includes an interior end surface 614 operable to abut the tip 596 of the rear leg 572. Each of the end caps 610 further include a sloped or angled ramp 616 to facilitate installation of each of the retainers 550 on the shaving head 500.

To secure the retainers 550 to the housing 501, the tip 586 of the front leg 570 of each of the retainers 550 is guided or slid into the front slot 584 on each of the end caps 610. Next, with the tip 596 of the rear leg 572 is positioned to abut the ramp 616, a force is applied on the retainers 550 that causes the tip 596 of the rear leg 572 to slide down the ramp 616, toward and into the rear slot 594. The force causes the retainer body 552 to flex so that the tips 586, 596 compress together to allow the retainer body 552 to slide past the ramp 616. In this manner, the retainers 550 secure the components 513 onto the shaving head 500.

Turning to FIGS. 12-15, another embodiment of the present inventive concept is illustrated with a shaving head 700. Similar to the embodiment illustrated in FIGS. 1-5 with shaving head 100, in FIGS. 6-9 with shaving head 300, and in FIGS. 10 and 11 with shaving head 500, the shaving head 700 is operable to be coupled with the distal end 14 of the handle 12 and includes a housing 701. The housing 701 extends along a longitudinal axis X-X. The housing 701, as illustrated, has a substantially rectangular shape, but may be any suitable shape such as ovoid or circular without deviating from the scope of the present inventive concept. The shaving head 700 and the housing 701 include a top side 702 and a bottom side 704 opposite the top side 702. The bottom side 704 is proximate to the handle 12, and the top side 702 includes at least one skin contacting area. The housing 701 includes first and second longitudinal walls 706, 708. Each of the first and second longitudinal walls 706, 708 extends longitudinally along the longitudinal axis X-X between the top and bottom sides 702, 704 and in a direction Z of the housing 701. The first and second longitudinal walls 706, 708 extend parallel to each other. As with the first and second side walls 110, 112, first and second side walls extend parallel to each other and between the first and second longitudinal walls 706, 708 along a direction Y of the housing 701. The first and second side walls also extend between the top and bottom sides 702, 704 along the direction Z of the housing 701. The housing 701 may be made of plastic, metal, another suitable material, or any combination thereof without deviating from the scope of the present inventive concept.

The shaving head 700 includes a plurality of shaving head components 713 which assist and contribute to the shaving experience of the user. One of the components 713 is a plurality of blades 716 disposed and retained within the housing 701. The blades 716 extend along the longitudinal axis X-X. In at least one example, the shaving head 700 can include one, two, three, four, or more of the blades 716 without deviating from the scope of the present inventive concept. The blades 716 may be movably disposed or freely mounted, in the housing 701. For example, the blades 716 may be coupled with elastic fingers which extend from the housing 701. In other examples, the blades 716 may be fixedly disposed in the housing 701. It is foreseen that a distance between the legs 770, 772 may be adjusted to increase or decrease exposure of the blades 716, thereby providing a desired blade exposure.

The plurality of shaving head components 713 also include a cap 714, a lubricating strip 715, and a guard bar 718 on and/or retained within the shaving head 700. Additional components, e.g., a cover and/or one or more trimming blades, may also be included on and retained within the shaving head 700 without deviating from the scope of the present inventive concept.

A plurality of shaving head components 713 is retained within the shaving head 700 by retainers 750. For example, the retainers 750 are operable to retain the blades 716, the cap 714, the lubricating strip 715, and the guard bar 718 within the shaving head 700. The retainers 750 are installed on a respective one of the side walls of the housing 701. It is foreseen that the retainers 750 may be installed in other walls or only one of the side walls of the housing 701 as desired without deviating from the scope of the present inventive concept. As illustrated, the retainers 750 retain the components 713 by securely abutting and partially covering (i) a portion of the components 713, e.g., lateral sides or sides along the direction X of the components 713, and (ii) the side walls. It is foreseen that the retainers 750 may be operable to secure one or more other components 713 within or on the shaving head 700 without deviating from the scope of the present inventive concept. It is also foreseen that any one or more of the components 713 may be secured to the shaving head 700 without the retainers 750, e.g., via other means, without deviating from the scope of the present inventive concept.

The retainers 750 may be made of a resilient material such as plastic, metal, or other similar material or any combination thereof without deviating from the scope of the present inventive concept. Each of the retainers 750 include a central retainer body 752 that is generally flat and extends along a single plane in first and second directions. The retainer body 752 includes a front 754 extending toward and facing a front of the shaving head 700, a rear 756 extending toward and facing a rear of the shaving head 700, an exterior side 758 extending toward and facing an exterior side of the shaving head 700, and an interior side 760 extending toward and facing an interior side of the shaving head 700.

The retainer body 752 includes a front leg 770 extending from the front 754 of the retainer body 752 and a rear leg 772 extending from the rear 756 of the retainer body 752. It is foreseen that the retainer body 752 could include only one or more side legs extending from the exterior side 758 of the retainer body 752 without deviating from the scope of the present inventive concept.

The front leg 770 and the rear leg 772 extend, at least partially, parallel to each other along the single plane defined by the retainer body 752. The front leg 770 includes a linear portion 780 extending parallel to the retainer body 752. The front leg 770 further includes a curved portion 782 that causes the front leg 770 to extend nonparallel to the retainer body 752. The curved portion 782 of the front leg 770 extends between the retainer body 752 and the linear portion 780 of the front leg 770. The linear portion 780 of the front leg 770 extends into and is received by a front slot 784 adjacent to the second longitudinal wall 708 of the shaving head 700 such that a tip 786 of the front leg 770 and a substantial portion of the linear portion 780 of the front leg 770 are housed within the front slot 784, and the tip 786 defines an outermost point of the retainer 750 in the first direction and along the single plane defined by the retainer body 752. The linear portion 780 of the front leg 770 is about 1.0 mm long and about 0.5 mm wide and the front slot 784 is about 1.05 mm long and about 0.45 mm wide.

The rear leg 772 includes a linear portion 790 extending parallel to the retainer body 752. The rear leg 772 further includes a curved portion 792 that causes the rear leg 772 to extend nonparallel to the retainer body 752. The curved portion 792 of the rear leg 772 extends between the retainer body 752 and the linear portion 790 of the rear leg 772. The linear portion 790 of the rear leg 772 extends into and is received by a rear slot 794 adjacent to the first longitudinal wall 706 of the shaving head 700 such that a tip 796 of the rear leg 772 and a substantial portion of the linear portion 790 of the rear leg 772 are housed within the rear slot 794, and the tip 796 defines an outermost point of the retainer 750 in the second direction and along the single plane defined by the retainer body 752. The linear portion 790 of the rear leg 772 is about 1.0 mm long and about 0.5 mm wide and the rear slot 794 is about 1.05 mm long and about 0.45 mm wide.

The retainer body 752 includes an interior abutment surface 800 on an interior side of the retainer body 752 that faces toward the bottom side 704 of the shaving head 700. The interior abutment surface 800 of the retainer body 752 is operable to abut one or more of the plurality of shaving head components 713. The linear portion 780 of the front leg 770 includes an exterior abutment surface 802 on an exterior side of the front leg 770 that faces away from the bottom side 704 of the shaving head 700. The exterior abutment surface 802 of the front leg 770 is operable to abut a front upper interior surface 804 of the front slot 784. The linear portion 790 of the rear leg 772 includes an exterior abutment surface 806 on an exterior side of the rear leg 772 that faces away from the bottom side 804 of the shaving head 700. The exterior abutment surface 806 of the rear leg 772 is operable to abut a rear upper interior surface 808 of the rear slot 794. In this manner, the retainer body 752 and the legs 770, 772 cooperatively secure the one or more of the plurality of shaving head components 713 on or within the shaving head 700.

The slots 784, 794 are defined by an end cap 810 on each of the side walls of the shaving head 700. The front slot 784 is positioned adjacent to the second longitudinal wall 708 and includes an interior end surface 812 that is spaced from the tip 786 of the front leg 770. The rear slot 794 is positioned adjacent to the first longitudinal wall 706 and includes an interior end surface 814 that is spaced from the tip 796 of the rear leg 772. Each of the end caps 810 further include opposing slopes or angled portions 816, 818 on each side of each of the end caps 810 to facilitate installation of each of the retainers 750 on the shaving head 700.

To secure the retainers 750 to the housing 701, the tip 786 of the front leg 770 of each of the retainers 750 is guided or slid into the front slot 784 on each of the end caps 810. Next, with the tip 796 of the rear leg 772 is positioned to abut the ramp 816, a force is applied on the retainers 750 that causes the tip 796 of the rear leg 772 to slide down the ramp 816, toward and into the rear slot 794. The force causes the retainer body 752 to flex so that the tips 786, 796 compress together to allow the retainer body 752 to slide past the ramp 816. In this manner, the retainers 750 secure the components 713 onto the shaving head 700. Alternatively, the retainers 750 may be secured to the housing 701 by guiding or sliding the tip 796 of the rear leg 772 of each of the retainers 750 into the rear slot 794 on each of the end caps 810. Next, with the tip 786 of the front leg 770 is positioned to abut the ramp 818, a force is applied on the retainers 750 that causes the tip 786 of the front leg 770 to slide down the ramp 818, toward and into the front slot 784. The force causes the retainer body 752 to flex so that the tips 786, 796 compress together to allow the retainer body 752 to slide past the ramp 816. In this manner, the retainers 750 secure the components 713 onto the shaving head 700. Alternatively, the retainers 750 may be secured to the housing 701 by positioning each of the tips 786, 796 to abut one of the ramps 816, 818. A force is applied on the retainers 750 that causes the tips 786, 796 to simultaneously slide down the ramps 816, 818, toward and into the slots 784, 794. The force causes the retainer body 752 to flex so that the tips 786, 796 compress together to allow the retainer body 752 to slide past the ramps 816, 818. In this manner, the retainers 750 secure the components 713 onto the shaving head 700.

It will be appreciated by those skilled in the art that changes could be made to the embodiments described above without departing from the broad inventive concept thereof. It is understood, therefore, that the present invention disclosed herein is not limited to the particular embodiments disclosed, and is intended to cover modifications within the spirit and scope of the present invention.

What is claimed is:

1. A shaving head comprising:

a housing; and one or more shaving head components selected from the group consisting of at least one blade defining a shaving plane, a guard bar, a cap, at least one lubrication strip or combinations thereof, the housing having a top portion including at least one skin contacting area and exposing the shaving plane, a bottom side opposite the top side in relation to the housing and being proximate to a handle, two longitudinal walls extending along the longitudinal axis between the top side and the bottom side, and two side walls connecting the two longitudinal walls and extending between the top side and the bottom side, the shaving head component being partially covered and secured to the housing by two retainers, each of the two retainers securely mounted on a corresponding one of the two side walls of the shaving head, each of the two retainers comprising:

a retainer body extending along a plane substantially parallel with the shaving plane in a first direction and a second direction opposite the first direction, the retainer body being positioned along the top portion of the housing, the retainer body having: (i) a front leg extending from a front of the body in the first direction, a tip of the front leg defining an outermost point of the retainer along the first direction, (ii) a rear leg extending from a rear of the body in the second direction, (iii) at least one side leg extending from an exterior side of the retainer body to at least partially surround an exterior side of the shaving head and abutting the bottom portion of the housing of the shaving head;

wherein each of the front leg and the rear leg (i) at least partially surrounds a portion of the shaving head, or (ii) extends into a portion of the shaving head.

2. The shaving head of claim 1, wherein the at least one side leg extends from the retainer body perpendicular to the first direction and the second direction.

3. The shaving head of claim 1, wherein the at least one side leg is a plurality of side legs, wherein each of the side legs extend parallel to each other and at least partially along the plane, and wherein each of the side legs is operable to surround a side portion of the shaving head and abut a bottom portion of the shaving head.

4. The shaving head of claim 1, wherein the front leg includes (i) a linear portion extending parallel to the body along the plane, and (ii) a curved portion that causes the front leg to extend nonparallel to the body.

5. The shaving head of claim 1, wherein each of the body, the rear leg, and the at least one side leg defines and partially surrounds an interior cavity operable to receive a portion of the housing when mounted onto the shaving head.

6. The shaving head of claim 5, wherein the body includes an abutment surface operable to abut one or more of the plurality of shaving head components.

7. The shaving head of claim 6, wherein each of the front leg, the rear leg, and the at least one side leg include an abutment surface operable, when the retainer is mounted onto the shaving head, (i) to abut a bottom side of the shaving head, or (ii) to be received by a slot in an end cap of the shaving head.

8. The shaving head of claim 7, wherein the abutment surface of the body, the rear leg, and the at least one side leg is on an interior side facing the interior cavity, and wherein the abutment surface of the front leg is on an exterior side.

9. The shaving head of claim 1, wherein the rear leg includes (i) a linear portion extending parallel to the body along the plane, and (ii) a curved portion that causes the rear leg to extend nonparallel to the body.

10. The shaving head of claim 9, wherein at least one of the front leg and the rear leg is received into a respective slot when the body flexes.

11. The shaving head of claim 10, wherein the body is formed of a resilient material, wherein the body flexes upon application of a force on the at least one of the front leg and the rear leg against the housing of the shaving head when the retainer is being mounted onto the shaving head.

12. The shaving head of claim 11, wherein the at least one of the front leg and the rear leg are configured to slide along an angled portion of an end cap of the shaving head upon application of the force on the at least one of the front leg and the rear leg against the housing of the shaving head when the retainer is being mounted onto the shaving head.

13. The shaving head of claim 12, wherein the tip of the front leg is configured to abut and slide along the angled portion of the end cap upon application of the force on the front leg.

14. The shaving head of claim 13, wherein the tip of the front leg extends obliquely to an upper surface and a lower surface of the front leg.

* * * * *